US005967448A

United States Patent [19]

Berry et al.

[11] Patent Number: 5,967,448

[45] Date of Patent: Oct. 19, 1999

[54] METAL STRIP SHEARING AND COILING

[75] Inventors: John Berry; Brian Cooper; Martin Philipson, all of Sheffield, United Kingdom

[73] Assignee: Kvaerner Technology & Research Limited, Sheffield, United Kingdom

[21] Appl. No.: 09/118,831

[22] Filed: Jul. 20, 1998

[30] Foreign Application Priority Data

Jul. 21, 1997 [GB] United Kingdom ..... 9715358

[51] Int. Cl.[6] ..... B65H 18/08

[52] U.S. Cl. ..... 242/531.1; 242/532.7; 242/535.1; 242/535.5; 242/548.3; 226/181

[58] Field of Search ..... 242/529, 531.1, 242/532.7, 533.4, 533.6, 535, 535.1, 535.3, 535.4, 535.5, 548, 548.3; 72/148; 226/181, 185

[56] References Cited

U.S. PATENT DOCUMENTS

| | | | |
|---|---|---|---|
| 1,882,219 | 10/1932 | Harwood et al. | 72/148 |
| 2,212,243 | 8/1940 | Paul | 72/148 |
| 2,325,559 | 7/1943 | Washam, Jr. | 72/148 |
| 2,725,104 | 11/1955 | Wood | 242/531.1 |
| 3,100,605 | 8/1963 | Bond | 242/531.1 |
| 3,587,274 | 6/1971 | Rotter | 72/148 |
| 3,800,434 | 4/1974 | Edgington et al. | 226/181 |
| 3,808,765 | 5/1974 | Wahlers et al. | 242/535.4 |
| 3,905,218 | 9/1975 | Galletti | 72/148 |
| 3,913,367 | 10/1975 | Galletti | 242/532.7 |
| 4,004,747 | 1/1977 | Schulze | 242/533.4 |
| 4,063,440 | 12/1977 | Brashear . | |
| 4,306,438 | 12/1981 | Child et al. | 242/535.1 |
| 4,380,164 | 4/1983 | Kuwano . | |
| 4,404,831 | 9/1983 | Hild et al. . | |
| 4,422,690 | 12/1983 | Hirschmanner et al. | 72/148 |
| 4,770,227 | 9/1988 | Sporenberg et al. | 242/533.4 |
| 4,807,825 | 2/1989 | Elsner et al. | 242/535.1 |
| 4,964,587 | 10/1990 | Oki et al. | 242/535.1 |
| 5,152,522 | 10/1992 | Yamashita | 226/185 |
| 5,275,345 | 1/1994 | Stahl et al. . | |
| 5,326,011 | 7/1994 | Mager et al. | 226/181 |
| 5,479,807 | 1/1996 | Moser | 72/148 |

FOREIGN PATENT DOCUMENTS

| | | |
|---|---|---|
| 0 034 578 | 8/1981 | European Pat. Off. . |
| 0 294 480 A1 | 12/1988 | European Pat. Off. . |
| 764468 | 12/1956 | United Kingdom . |
| 838422 | 6/1960 | United Kingdom . |
| 2 306 448 | 5/1997 | United Kingdom . |
| WO 96/30137 | 10/1996 | WIPO . |

*Primary Examiner*—Donald P. Walsh
*Assistant Examiner*—William A. Rivera
*Attorney, Agent, or Firm*—Oliff & Berridge, PLC

[57] ABSTRACT

An apparatus for coiling successive lengths of metal strip onto mandrels changes the strip path from a path leading to the mandrel currently being wound to a path to a new mandrel when the current strip ends and a new strip appears. The new mandrel has a mandrel strip guide that includes a chain of driven mandrel guide rollers located around the new mandrel in its initial position to receive the leading edge of a new length of strip and guide it around the mandrel. Adjacent rollers in the chain have interlocking grooves and flanges. Similar chains of rollers are used to guide the strip between the shears and the mandrels. The new mandrel is positioned in an initial position such that the strip path to it is a straight path, and the mandrels are mounted on a carousel which moves that mandrel to a second position such that the strip path to it is an angled path, the first segment of which is common with the first part of the straight strip path. A tail restraining unit holds the tail of the old strip onto its mandrel.

11 Claims, 6 Drawing Sheets

METAL STRIP SHEARING AND COILING

BACKGROUND OF THE INVENTION

The present invention relates to shearing and coiling metal strip. In particular, it is concerned with guiding the strip onto a coil at the end of a rolling mill line, and shearing the strip and transferring the strip to a second coil when a first coil is complete, whilst at the same time permitting the continuous production of the strip at an uninterrupted rate.

Such shear and guiding systems for shearing and guiding the strip to alternate coils are well known in the art. In fact, more than two coils may be used if the cycle time for the removal of the completed coil is greater than the time to complete the coiling of a single coil.

In a typical known system, the strip is first passed through a rotating shear unit, which comprises two cutting edges each mounted on a rotatable support on opposite sides of the strip so that the blades are coincident with the strip and act together to cut the strip when the rotatable supports are rotated. The rotatable supports rotate in the direction of the strip. The strip emerges from the shears towards two pairs of deflecting rolls placed one after the other. Each pair of deflecting rolls has an associated spool or mandrel located below the straight path from the shears. Various deflector plates are used in combination with the deflector rolls to guide the strip onto the spool or mandrel.

Supposing that the strip is being wound on the second spool, the first deflecting rolls will be open, allowing the strip to pass through them without deflection and on towards the second pair of deflecting rolls, which will deflect the strip to its associated spool. As that spool becomes nearly full, the strip is sheared and the part ahead of the shears will continue along the existing strip path, and will be wound onto the current spool.

As the end of that part passes through the first deflecting rolls and the front edge of the next part of the strip approaches those deflecting rolls, those rolls will be operated to engage with the strip and deflect it onto the spool associated with those rolls. That spool is then filled to form the next coil whilst the previous coil is removed from its spool.

When the second spool is nearly full, the shears are again operated, and the deflecting rolls associated with that spool are opened to allow the front edge of the new part of the strip to pass straight through and on to the deflecting rolls associated with the second spool, which should by then have been changed in readiness.

This known system is typical of the way that strip is formed into coils at the end of the strip production. There are variations on this theme in which the spools are movable to pick up the strip after each cut, and also there are alternative means of diverting the path of the strip, some of which rely merely on gravity or the inertial movement of the strip to cause the strip to take up a new path.

These known systems have the disadvantage that it is necessary to control the time of engagement of the guiding rolls or guiding mechanism accurately, immediately after the cutting has taken place. This can cause problems for the cutting and coiling of thin strip moving at high strip speeds. If the guiding rolls are engaged too soon, then the previous strip length will be engaged and this will cause it to be deflected in the wrong direction. Alternatively if the engaging roll is engaged too late, the next strip length will proceed on its previous path and may overshoot the corresponding spool. Thus the engaging roll must move very quickly into and out of position, and the dynamic limitations of this movement of the engaging rolls limits the strip speeds that can be used. Thus it is necessary to ensure that the movement of the guiding rolls is precisely timed with the action of the rotating shears.

A further disadvantage of known systems is that thin strip especially is very easily bent by hitting stationary guides or other guidance mechanisms which can throw the strip out of line with the desired path into the coiling stage or cause it to jam. Similarly, for systems which rely on inertia or gravity, the strip speeds are limited because at high speeds the strip may not fall in time or in a predictable way because it is influenced by aerodynamic effects.

For cold rolling, a technique known as carousel coiling has been developed. For this technique, there is provided apparatus for coiling successive lengths of metal strip onto mandrels, comprising means for changing the strip path from a path leading to the mandrel currently being wound to a path to a new mandrel when the current strip ends and a new strip appears, wherein the new mandrel is positioned in an initial position such that the strip path to it is a straight path, and means are provided for moving that mandrel to a second position such that the strip path to it is an angled path the first segment of which is common with the first part of the straight strip path.

The tail end of the old length of strip is pulled along the angled path by the main body of that length which is already coiled on its mandrel, and therefore cannot go seriously astray. After the shear is operated, the leading edge of the new length of strip continues straight ahead instead of following the angled path because of the inertia and weight of the strip. The leading edge of the new length of strip is guided onto the mandrel by a moving belt which is wrapped part of the way around the mandrel in such a way that the leading edge of the new length of strip is caught between the belt and the mandrel. This type of apparatus is known as a belt wrapper.

The present invention is particularly concerned with handling hot thin strip. This involves a number of additional problems compared to handling strip resulting from cold rolling.

Mills rolling cold strip generally slow down during the changeover from one coiling mandrel to the other. This reduces the aerodynamic effects on the strip which could cause it to take the wrong path. It also reduces the speed at which the belt wrapper or other strip guidance mechanism has to operate. However, hot strip mills cannot slow down during coiling for metallurgical reasons. Consequently, the belt wrapper or other guidance mechanism has to operate at full speed. The life of conventional belt materials or chains is severely reduced by operating at the high speeds required for thin hot strip. In addition the high temperature of the strip is liable to cause damage to the belt or chain material.

In addition, guidance of the strip is more difficult because the hot strip has lower strength than cold strip and is therefore more liable to bend and follow an incorrect path; also, with higher speeds, aerodynamic effects are more liable to cause deflection of the head of the strip from the desired path.

The general object of the invention is to provide means for improved guidance of hot rolled strip in strip shearing and coiling apparatus.

SUMMARY OF THE INVENTION

According to the invention there is provided apparatus for coiling successive lengths of metal strip onto mandrels, comprising means for changing the strip path from a path leading to the mandrel currently being wound to a path to a new mandrel when the current strip ends and a new strip appears, characterised by strip path guide means comprising at least one chain of driven rollers.

Preferably, in the or each chain of rollers, adjacent rollers have interlocking grooves and flanges. Conventional rollers are separate, i.e. one after the other. With such separate rollers, there is a possibility that the strip could go astray and poke out between two adjacent rollers (or start to do so and then buckle as it gets pushed back again). With belts, there is the same danger where one belt begins or ends and the next belt (or a roller) takes over. Interlocking rollers virtually eliminate this danger.

The interlocking rollers are preferably applied at several different places in the present apparatus. The present apparatus preferably includes a pair of pinch rolls between the shear unit and the mandrels. Two sets of interlocking rollers are preferably provided between the shear unit and the pinch rolls, one on each side of the strip. Two further sets of interlocking rollers (again one on each side of the strip) are preferably provided between the pinch rolls and the point at which the two paths for the strip, to the old mandrel and the new mandrel, diverge. Finally, a set of interlocking rollers is provided for guiding the front end of the start of a new strip around the mandrel to initiate winding. Here, the strip end has to be guided into a curved path, which is more difficult than guiding it along a straight path.

BRIEF DESCRIPTION OF THE DRAWINGS

A combined shearing and coiling apparatus embodying the invention will now be described in more detail with reference to the drawings, in which.

DETAILED DESCRIPTION OF PREFERRED EMBODIMENTS

Figure 1:
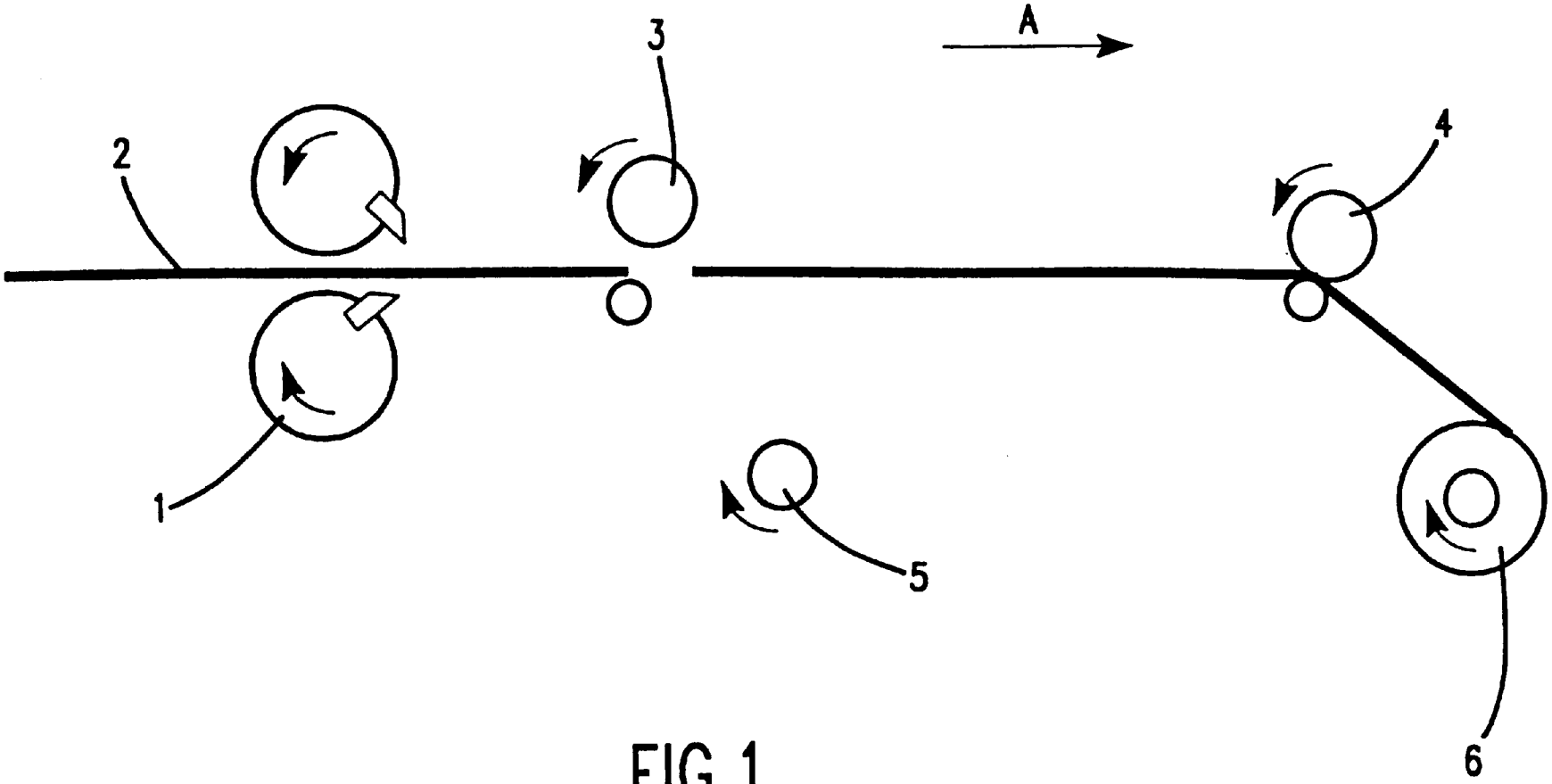
FIG. 1 (PRIOR ART)
FIG. 1 is a schematic view of a known shearing and deflecting system.

FIG. 1 shows an example of a known system. The strip 2 travels from left to right in the direction of arrow A. The first stage of the shearing and coiling system is a rotating shear 1, which comprises two cutting edges each mounted on a rotatable support on opposite sides of the strip so that the blades are coincident with the strip and act together to cut the strip when the rotatable supports are rotated. The rotatable supports rotate in the direction of the strip, the upper support anti-clockwise and the lower one clockwise.

There are two coiling spools 5 and 6 onto which the strip is alternately wound, with deflecting rolls 3 and 4 corresponding respectively to the two coiling spools. Thus, when the strip is being coiled onto the spool 6, the deflecting rolls 4 are engaged to guide the strip onto the spool 6, as shown in FIG. 1. When the spool 6 is full and the coil is complete, the rotating shear 1 is operated and the strip is cut. (Clearly the coil will not quite be complete at the time of cutting but will be just less than complete by the amount of the distance of the strip from the rotating shear to the coil.) Immediately after the strip is cut, the deflecting rolls 3 are engaged to guide the strip to the second spool 5, which is then filled to form the next coil whilst the previous coil is removed from the spool 6. When the coil on spool 5 nears completion, the shears 1 are operated again, and the deflecting rolls 3 are opened to allow the front edge of the new length of strip to pass straight through to the deflecting rolls 4 and spool 6.

Figure 2:
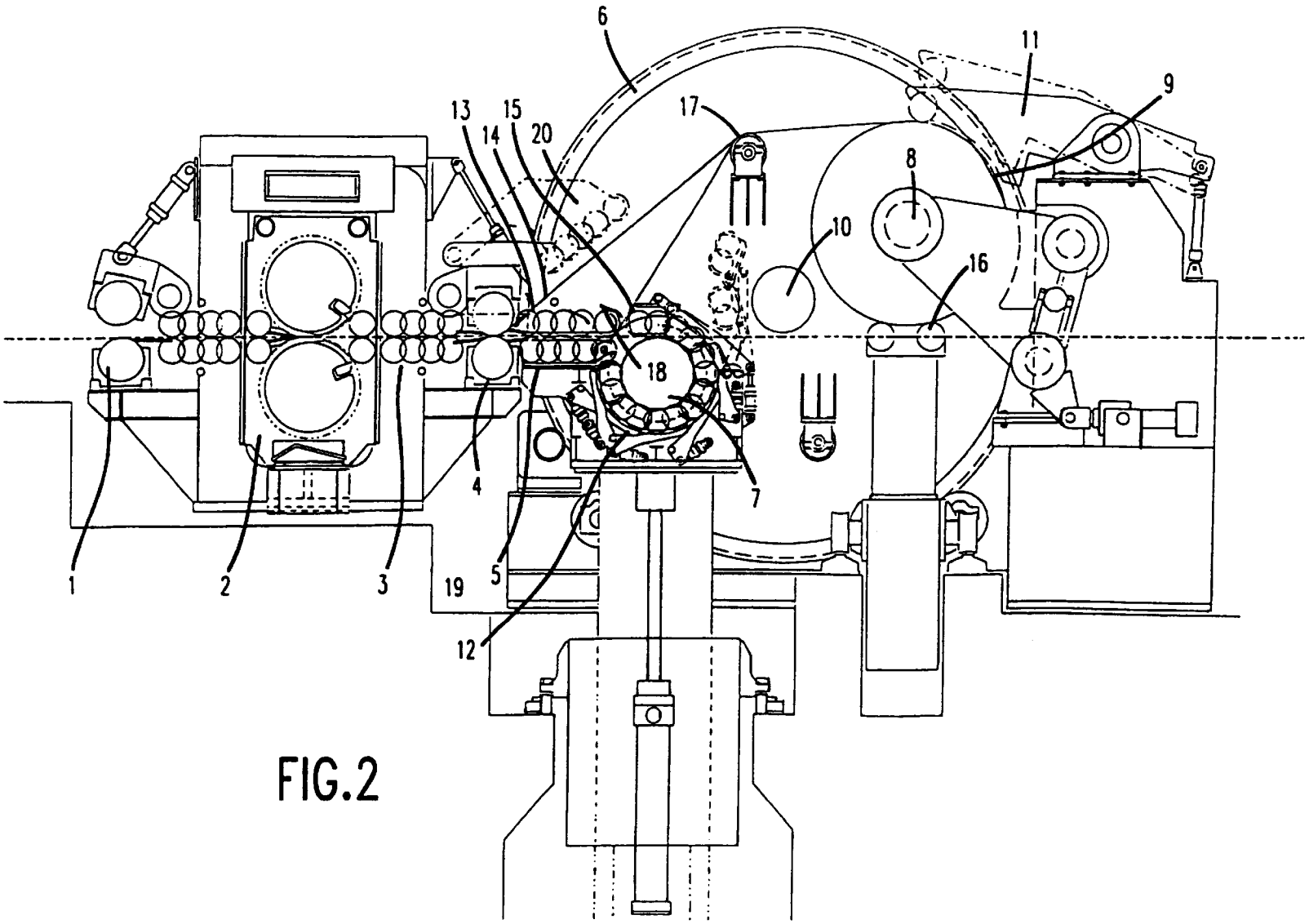
FIG. 2 is a schematic view of a combined shearing and coiling apparatus embodying the invention.

FIG. 2 shows an apparatus for the combined shearing, guiding and coiling of continuous metal strip embodying the invention. The metal strip, moving from left to right, passes through a pinch roll 1 which serves to provide the required tension in the strip. The strip then passes through a high speed strip shearing unit 2, which shears the continuous strip into the desired lengths.

When thin strip travelling at high speed is cut, the front end of the new length of strip created by the cut needs to be very carefully guided so that it does not take the wrong path resulting from the deflecting effect of the shear. The thin strip is very easily bent and diverted by hitting any guide or other part of the apparatus. In the present apparatus, two sets of guide rollers 3 are provided after the shearing unit 2, one on each side of the strip, and these rollers are driven at a speed which is synchronised with the speed of the strip.

Each of the two opposite sets of guide rollers has rollers with corresponding interlocking grooves and flanges around their circumferences, and the rollers are arranged close together with the distance between the axes of neighbouring rolls in each set being less than the external diameter of each roll at the flanges. Thus the adjacent rollers can be placed closer together than their maximum diameters would otherwise allow, thus providing more control and effective guiding of the strip.

The next stage in the apparatus is a further pinching unit 4 again to control the tension in the strip. This pinching unit may not always be necessary.

The next stage is two further sets of guide rollers 5, one on each side of the strip. Again, adjacent rollers in each set are interlocking, and are driven to rotate at a speed which is synchronised with the speed of the strip.

The next stage of the apparatus is the coiling unit, which comprises first and second coiling mandrels 8 and 7 arranged on a rotatable carousel 6. In FIG. 2 the strip follows the angled path 14 around the upper roll of the pinch roll 4 and the deflector roll 17 onto the first mandrel 8. Before the strip is cut, the upper guide rollers assembly 20 is moved into position 13 adjacent to the lower guide rollers 5 so that the strip takes the more steeply angled path past the water jet 18 to the deflector roll 17. When the strip is cut, the new front end of the subsequent length of strip is directed towards the second mandrel 7 by the guide rollers 5. The rear end of the previous strip continues along the angled path to complete the completed coil on the first mandrel 8. A tail restraining unit 11 is to hold the tail of the strip onto the coil at the end of the coiling operation. The completed coil 9 may then be removed by supporting it on the coil car 16.

Once the new length of strip has engaged with the second mandrel 7 and is being wound on it, the carousel is rotated through 180°. The speed of the rotation of the carousel, combined with the rotation of the mandrel, is synchronised with the speed of the strip.

When the coil of strip forming on the second mandrel 7 nears completion the strip follows the same angled path 14 and the procedure is repeated.

The first and second mandrels 8 and 7 are rotatably driven by respective electric mandrel motors (not shown) which are attached to the carousel 6 and move with it. The motors are located behind the mandrels 8 and 7 in FIG. 2. Preferably slip rings are provided on the carousel 6 to supply power to the mandrel motors. The mandrels 8 and 7 are driven to provide a circumferential speed which corresponds to the speed of the strip.

The mandrels 8 and 7 are expandable; they are expanded during the start of the coiling process and collapsed when the coiling process is complete and the mandrel is in the removal position, in order that the coil may be removed from the mandrel.

Each of the mandrels 8 and 7 includes internal actuating means (not shown) to operate it between the expanded and collapsed positions. The actuating means is in the form of an actuating rod which extends inside the mandrel. Each mandrel motor has a hollow drive shaft through which the actuator rod extends into the mandrel in order to collapse and expand the mandrel.

When the strip is travelling to the mandrel 8, it follows the path 14. Before the strip is cut to start a new coil, the guide roller assembly 20 is lowered so that the path of the strip is arranged to be at a large angle to the original strip path. The deflector roll 17 contributes to creating a large angle in the strip path. This large angle permits the gap between the guide roller 15 and the end of the second guide means 13 to be small. This ensures that the front end of the newly formed strip length is correctly received by the guide roller 15 and guided by that roller into the mandrel guide means 12. In addition, the water jets 18 help to ensure that the end of the strip does not pass through this small gap. The new length of strip is then guided onto the mandrel 7 by means of the mandrel strip guide means 12, which wraps the strip around the mandrel 7. The mandrel strip guide means 12 comprises a set of rollers which are interlocking and which are driven at a speed which is synchronised with the speed of the strip. Additional water jets ensure that the end of the strip remains in contact with the mandrel in the region just before it starts the second lap.

During the start of the coiling onto the second mandrel 7, the strip guide means 13 and the mandrel guide means 12 are arranged to be as close together as possible, in order to provide close guidance to the new front end of strip. However, it is necessary to move the strip guide means 13 and the mandrel guide means 12 out of the way of the path of the mandrel when the carousel is rotated after the coiling of the strip has been successfully started.

When the coiling of the strip has been successfully started, the strip guide means 13 is swung upwardly out of the way of the mandrel path and the lower row 5 is swung downwardly out of the way. Similarly, the mandrel guide means 12, which comprises a single row of guide rollers, is split into an upper half and a lower half. When the coiling of the strip has been successfully started, the upper half is swung upwardly and to the right as shown in FIG. 2, and the lower half remains fixed to its support and is lowered downwardly with this fixed support to a position in which it is clear from the path of the mandrel 7.

Figure 3:
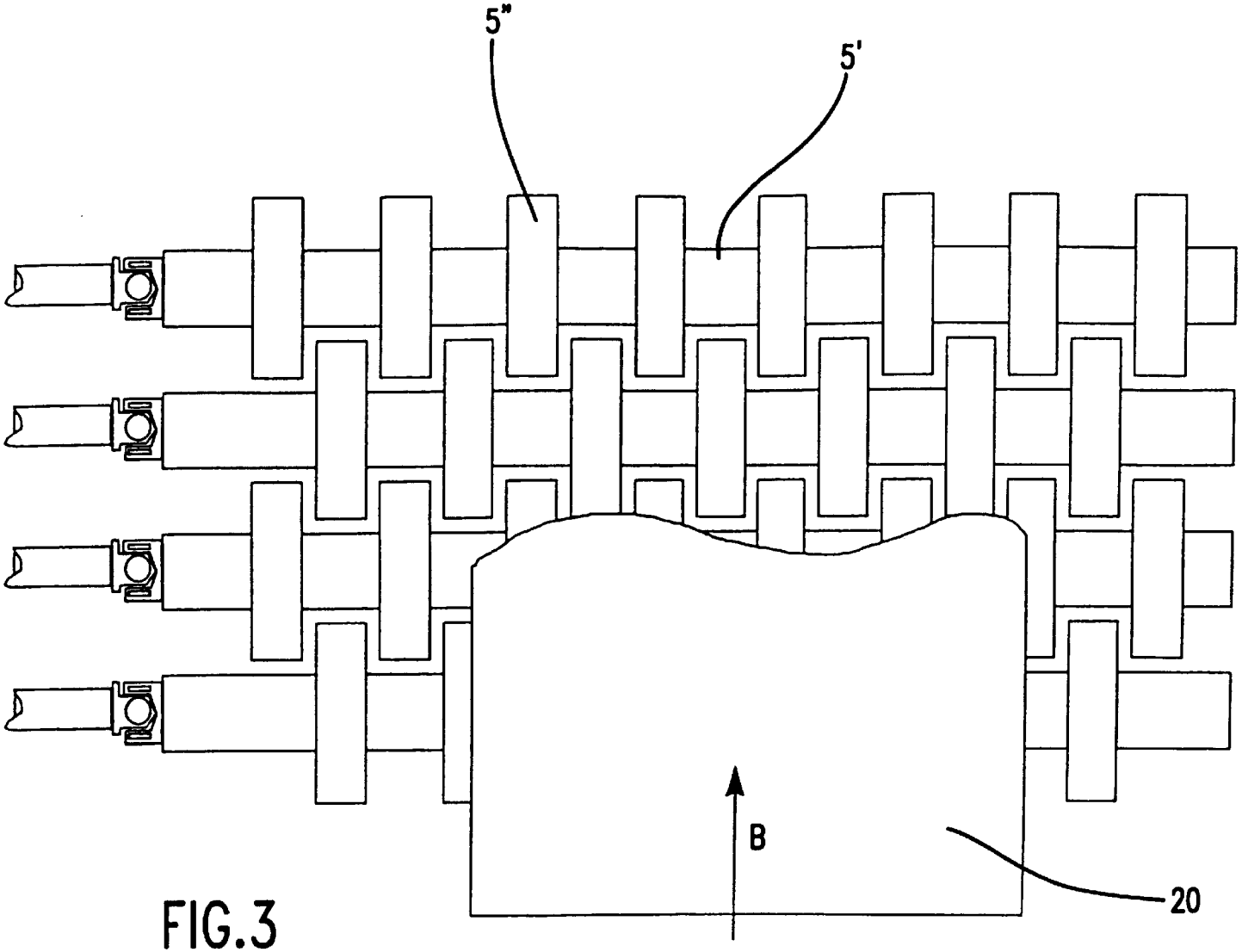
FIG. 3 is a diagrammatic plan view of one set of interlocking rollers.

FIG. 3 is a plan view of the guide rollers 5 showing the interlocking grooves 5' and flanges 5" on the rolls. For illustration, the head end of a strip 20 is shown travelling in direction B on the rollers. The interlocking rollers 5 make it impossible for the strip to pass between adjacent rollers as it could do with conventional rollers.

Figure 4:
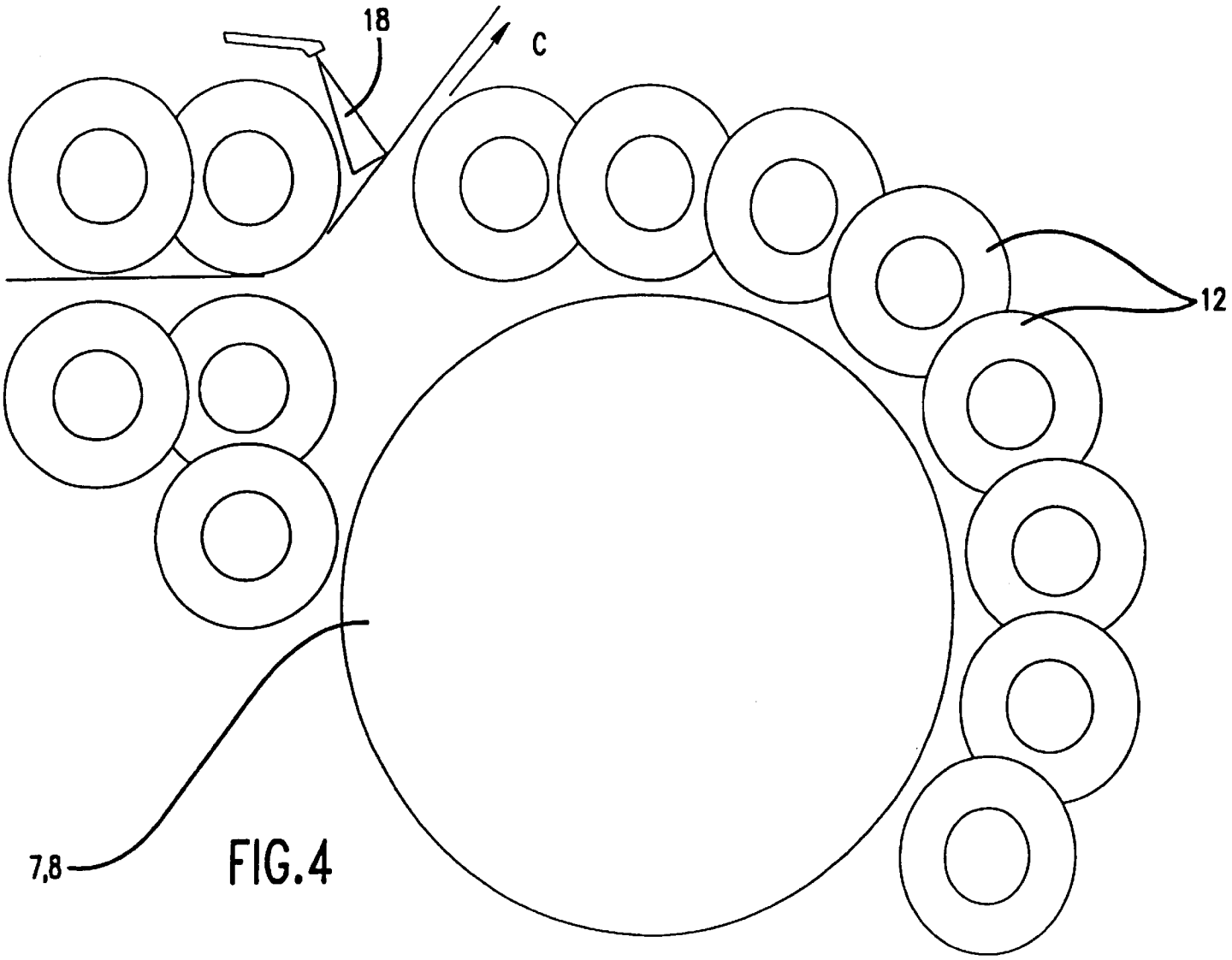
FIG. 4 is an expanded schematic side view of the strip guiding arrangement in the vicinity of the mandrel with the strip taking an angled path to the other mandrel (not shown)

FIG. 4 shows all expanded view of the arrangement of the mandrel strip guide means 12 in the form of interlocking guide rollers 12 and mandrel 7, 8 with the strip following the steeply angled path C to the other mandrel. Water jets 18 are provided between the previous guidance means 13 and the mandrel guide means 12 to assist in the guidance of the strip 20 across the gap between these two guidance means.

Figure 5:
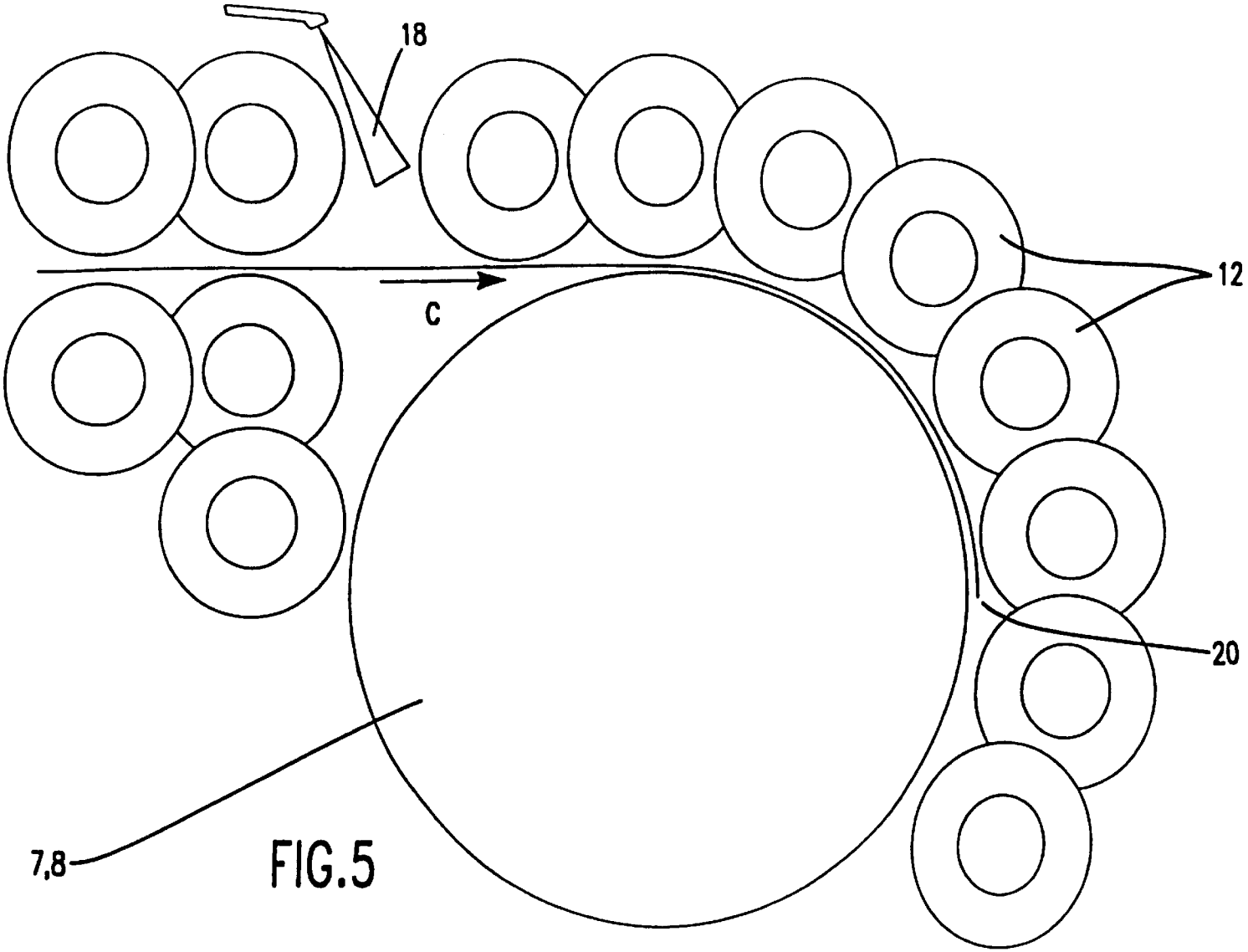
FIG. 5 is an expanded schematic side view of the strip guiding arrangement in the vicinity of the mandrel during the threading of a new leading end of the strip.

FIG. 5 shows the same view as FIG. 4 but with the new leading edge of the strip 20 taking the new path C between the mandrel 7, 8 and guide rollers 12. The water jets 18 may be activated at this stage help to ensure that the new leading edge does not pass through the gap between the guide rolls.

Figure 6:
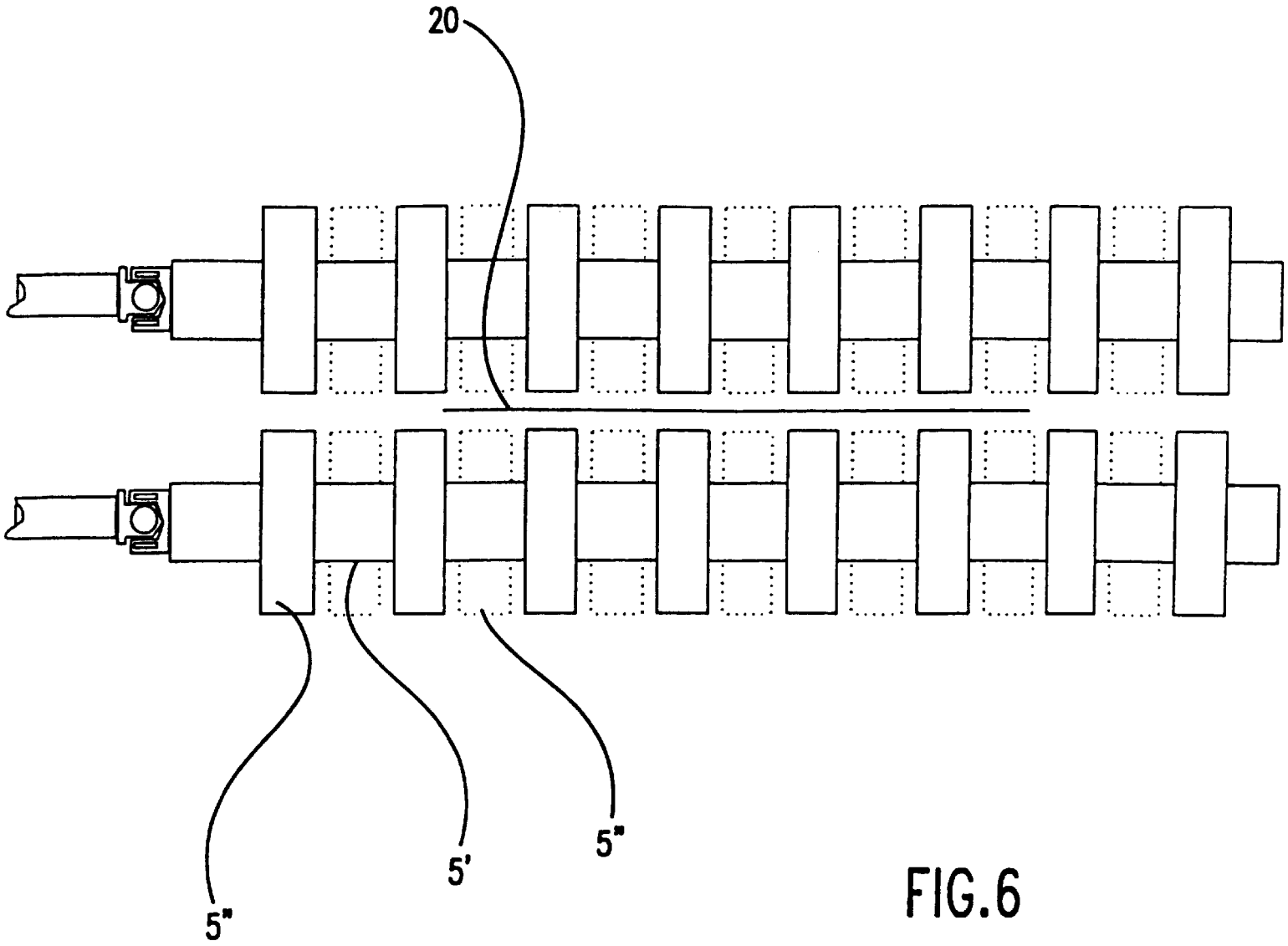
FIG. 6 is an end elevation of a set of interlocking rollers.

FIG. 6 is an end view of the guide roller arrangement showing the strip 20 being guided by the flanges 5" of the rolls. The grooves 5' allow the flanges 5" of the adjacent roll to interlock and prevent the strip 20 from passing between the rolls.

The first strip guide means 3, the second strip guide means 13, and the mandrel strip guide means 12 have all been shown as interlocking rollers guide means. However, one or more of these guide means could be replaced with alternative guide means such as non-interlocking rollers, moving belts, or air jets.

We claim:

1. An apparatus for coiling successive lengths of metal strip onto a plurality of mandrels, comprising:

means for changing a strip path from a path leading to a first mandrel currently being wound to a path to a second mandrel when a current strip ends and a new strip appears;

strip path guide means comprising at least one chain of driven rollers; and water/air jets directed into a gap in a strip guidance mechanism through which a rear end of the current strip passes, to assist guidance of a lead end of the new strip, wherein, in the at least one chain of driven rollers, adjacent rollers have interlocking grooves and flanges.

2. An apparatus for coiling successive lengths of metal strip onto a plurality of mandrels, comprising:

means for changing a strip path from a path leading to a first mandrel currently being wound to a path to a second mandrel when a current strip ends and a new strip appears;

strip path guide means comprising at least one chain of driven rollers; and water/air jets directed into a gap in a strip guidance mechanism through which a rear end of the current strip passes, to assist guidance of a lead end of the new strip, wherein, in the at least one chain of driven rollers, adjacent rollers have interlocking grooves and flanges, and a deflector roll around which the current strip passes to the first mandrel.

3. An apparatus for coiling successive lengths of metal strip onto a plurality of mandrels, comprising:

means for changing a strip path from a path leading to a first mandrel currently being wound to a path to a second mandrel when a current strip ends and a new strip appears, the second mandrel positioned in an initial position such that the strip path to it is a straight path;

means for moving the second mandrel to a second position such that the strip path to it is an angled path, the first segment of which is common with the first part of the straight strip path; and strip path guide means comprising at least one chain of driven rollers, wherein, in the at least one chain of driven rollers, adjacent rollers have interlocking grooves and flanges.

4. Apparatus according to claim 3, further comprising a carousel on which the mandrels are mounted and which is rotatable to carry the new mandrel from its initial to its second position.

5. Apparatus according to claim 4, wherein the carousel carries, for each mandrel, an electric motor to drive that mandrel.

6. Apparatus according to claim 4, wherein deflector rolls are mounted on the carousel so that rotation of the carousel to move the mandrel positions also causes the strip to come into contact with one of the deflector rolls and the strip path to be diverted around the contacted deflector roll.

7. Apparatus for coiling metal strip passing from a rolling line and through strip cutting means into a succession of coils on respective coiling means, the apparatuscomprising:

means for positioning a coiling means in an initial position in a substantially straight strip path from the cutting means to receive a leading end of a length of strip;

means for subsequently moving the coiling means to a second position such that the length of strip being coiled on that coiling means is caused to follow a first angled path;

strip guide means for guiding the length of strip, after the coiling means has moved to the second position, to a second angled path, the second angled path being steeper than the first angled path; and wherein a lead end of each subsequent length of strip follows the substantially straight strip path to the initial position of a second coiling means for that length of strip.

8. Apparatus according to claim 7, wherein the strip guide means is located adjacent to the straight strip path on the side of the length of strip opposite to the initial position of the coiling means, the apparatus further comprising:

means for moving the strip guide means away from the straight strip path when the coiling means is being moved to its second position so that the strip follows a path which is defined at a point adjacent to the leading end of the strip guide means to the coiling means as the coiling means is moved, and returning the strip guide means to an initial position so that the strip follows a path which is deflected at the trailing end of the strip guide means, whereby an angle of deflection of the strip is increased.

9. Apparatus according to claim 7, further comprising a carousel on which the coiling means are mountable, the carousel being rotated to move a coiling means mounted thereon from the initial position to the second position.

10. Apparatus according to claim 9, wherein the carousel carries deflector means for increasing the angle in the first and second angled paths to larger than an angle direct to the second position.

11. Apparatus according to claim 7, wherein the strip guide means comprises at least two interlocking rollers.

* * * * *